US007383790B2

(12) United States Patent
Francino et al.

(10) Patent No.: US 7,383,790 B2
(45) Date of Patent: Jun. 10, 2008

(54) METHOD AND APPARATUS FOR CONTROLLING SOOT BLOWING USING STATISTICAL PROCESS CONTROL

(75) Inventors: Peter N. Francino, Renfrew, PA (US); Xu Cheng, Pittsburgh, PA (US)

(73) Assignee: Emerson Process Management Power & Water Solutions, Inc., Pittsburgh, PA (US)

( * ) Notice: Subject to any disclaimer, the term of this patent is extended or adjusted under 35 U.S.C. 154(b) by 189 days.

(21) Appl. No.: 11/146,170

(22) Filed: Jun. 6, 2005

(65) Prior Publication Data

US 2006/0283406 A1 Dec. 21, 2006

(51) Int. Cl.
*F22B 37/48* (2006.01)

(52) U.S. Cl. ..... 122/379; 15/318.1; 700/275

(58) Field of Classification Search ..... 122/379, 122/392, 396; 15/316.1, 318.1
See application file for complete search history.

(56) References Cited

U.S. PATENT DOCUMENTS 3,137,278 A * 6/1964 Thayer et al. ..... 122/392
4,085,438 A * 4/1978 Butler ..... 700/278
5,181,482 A * 1/1993 Labbe et al. ..... 122/392
5,764,535 A * 6/1998 Okazaki et al. ..... 700/274
6,325,025 B1 * 12/2001 Perrone ..... 122/379
6,736,089 B1 * 5/2004 Lefebvre et al. ..... 122/379
6,758,168 B2 7/2004 Koskinen et al.
7,109,446 B1 * 9/2006 Cheng et al. ..... 219/497

FOREIGN PATENT DOCUMENTS

GB 2 423 158 8/2006
JP 62-294804 12/1987

OTHER PUBLICATIONS

Search Report under section 17(5) issued in GB0610955.7 application by United Kingdom Patent Office on Nov. 7, 2006.

* cited by examiner

*Primary Examiner*—Gregory Wilson
(74) *Attorney, Agent, or Firm*—Marshall, Gerstein & Borun LLP

(57) ABSTRACT

A statistical process control system employs a consistent soot blowing operation for a heat exchange section of, for example, a fuel burning boiler, collects heat absorption data for the heat exchange section and analyzes the distribution of the heat absorption data as well as various parameters of the heat absorption distribution to readjust the soot blowing operation. The statistical process control system may set a desired lower heat absorption limit and a desired upper heat absorption limit and compare them, respectively, with an actual lower heat absorption limit and an actual upper heat absorption limit to determine the readjustment to be made to the soot blowing operation. Alternatively, the statistical process control system may be used to determine permanent slagging of the heat exchange section.

17 Claims, 7 Drawing Sheets

METHOD AND APPARATUS FOR CONTROLLING SOOT BLOWING USING STATISTICAL PROCESS CONTROL

TECHNICAL FIELD

This patent relates generally to computer software, and more particularly to computer software used in controlling soot blowing operations.

BACKGROUND

A variety of industrial as well as non-industrial applications use fuel burning boilers, typically for converting chemical energy into thermal energy by burning one of various types of fuels, such as coal, gas, oil, waste material, etc. An exemplary use of fuel burning boilers is in thermal power generators, wherein fuel burning boilers are used to generate steam from water traveling through a number of pipes and tubes in the boiler and the steam is then used to generate electricity in one or more turbines. The output of a thermal power generator is a function of the amount of heat generated in a boiler, wherein the amount of heat is determined by the amount of fuel that can be burned per hour, etc. Additionally, the output of the thermal power generator may also be dependent upon the heat transfer efficiency of the boiler used to burn the fuel.

Burning of certain types of fuel, such as coal, oil, waste material, etc., generates a substantial amount of soot, slag, ash and other deposits (generally referred to as "soot") on various surfaces in the boilers, including the inner walls of the boiler as well as on the exterior walls of the tubes carrying water through the boiler. The soot deposited in the boiler has various deleterious effects on the rate of heat transferred from the boiler to the water, and thus on the efficiency of any system using such boilers. It is necessary to address the problem of soot in fuel burning boilers that burn coal, oil, and other such fuels that generate soot in order to maintain a desired efficiency within the boiler. While not all fuel burning boilers generate soot, for the remainder of this patent, the term "fuel burning boilers" is used to refer to those boilers that generate soot.

Various solutions have been developed to address the problems caused by the generation and presence of soot deposits in boilers of fuel burning boilers. One approach is the use of soot blowers to remove soot encrustations accumulated on boiler surfaces through the creation of mechanical and thermal shock. Another approach is to use various types of soot blowers to spray cleaning materials through nozzles, which are located on the gas side of the boiler walls and/or on other heat exchange surfaces, where such soot blowers use any of the various media such as saturated steam, superheated steam, compressed air, water, etc., for removing soot from the boilers.

Soot blowing affects the efficiency and the expense of operating a fuel burning boiler. For example, if inadequate soot blowing is applied in a boiler, it results in excessive soot deposits on the surfaces of various steam carrying pipes and therefore in lower heat transfer rates. In some cases, inadequate soot blowing may result in "permanent fouling" within fuel burning boilers, meaning that soot deposits in the boiler are so excessive that such deposits cannot be removed by any additional soot blowing. In such a case, forced outage of the boiler operation may be required to fix the problem of excessive soot deposits, and boiler maintenance personnel may have to manually remove the soot deposits using hammers and chisels. Such forced outages are not only expensive, but also disruptive for the systems using such fuel burning boilers.

On the other hand, excessive soot blowing in fuel burning boilers may result in increased energy cost to operate the soot blowers, wastage of steam that could otherwise be used to operate turbines, etc. Excessive soot blowing may also be linked to boiler wall tube thinning, tube leaks, etc., which may cause forced outages of boiler use. Therefore, the soot blowing process needs to be carefully controlled.

Historically, soot blowing in utility boilers has been mostly an ad hoc practice, generally relying on a boiler operator's judgment. Such an ad hoc approach produces very inconsistent results. Therefore, it is important to manage the process of soot blowing more effectively and in a manner so that the efficiency of boiler operations is maximized and the cost associated with the soot blowing operations is minimized.

One popular method used for determining cleanliness of a boiler section and to control soot blowing operations is a first principle based method, which requires measurements of flue gas temperature and steam temperature at the boiler section inlets and outlets. However, because direct measurements of flue gas temperatures are not always available, the flue gas temperatures are often backward calculated at multiple points along the path of the flue gas, starting from the flue gas temperatures measured at an air heater outlet. This method is quite sensitive to disturbances and variations in air heater outlet flue gas temperatures, often resulting in incorrect results. Moreover, this method is a steady state method, and therefore does not work well in transient processes generally encountered in various boiler sections.

Another popular method used for determining cleanliness of a boiler section of a fuel burning boiler and to control soot blowing operations in a fuel burning boiler is an empirical model based method, which relies on an empirical model such as a neural network model, a polynomial fit model, etc. The empirical model based method generally requires a large quantity of empirical data related to a number of parameters, such as the fuel flow rate, the air flow rate, the air temperature, the water/steam temperature, the burner tilt, etc. Unfortunately the large amount of data makes the data collection process tedious, and prone to high amount of errors in data collection.

BRIEF DESCRIPTION OF THE DRAWINGS

The present patent is illustrated by way of examples and not limitations in the accompanying figures, in which like references indicate similar elements, and in which.

DETAILED DESCRIPTION OF THE EXAMPLES

A statistical process control system employs a consistent soot blowing operation for a heat exchange section of, for example, a fuel burning boiler, collects heat absorption data for the heat exchange section and analyzes the distribution of the heat absorption data as well as various parameters of the heat absorption distribution to readjust the soot blowing operation. The statistical process control system may set a desired lower heat absorption limit and a desired upper heat absorption limit and compare them, respectively, with an actual lower heat absorption limit and an actual upper heat absorption limit to determine the readjustment to be made to the soot blowing practice.

Generally speaking, the statistical process control system described herein is more reliable than the first principle based method and the empirical model based method, and is simple to implement as the statistical process control system requires only heat absorption data for implementation. Moreover, because the statistical process control system described herein uses heat absorption data, it is independent of, and not generally effected by disturbances and noise in flue gas temperatures, thus providing more uniform control over operation of soot blowers and cleanliness of heat exchange sections.

Generally speaking, an implementation of the statistical process control system measures heat absorption at various points over time to determine differences in heat absorption before and after a soot blowing operation, and calculates various statistical process control measurements based on such heat absorption statistics to determine the effectiveness of the soot blowing operation. The statistical process control system establishes a consistent soot blowing operation for the heat exchange section of a boiler or other machines and reduces the amount of data necessary for controlling the operation of the soot blowers.

Figure 1:
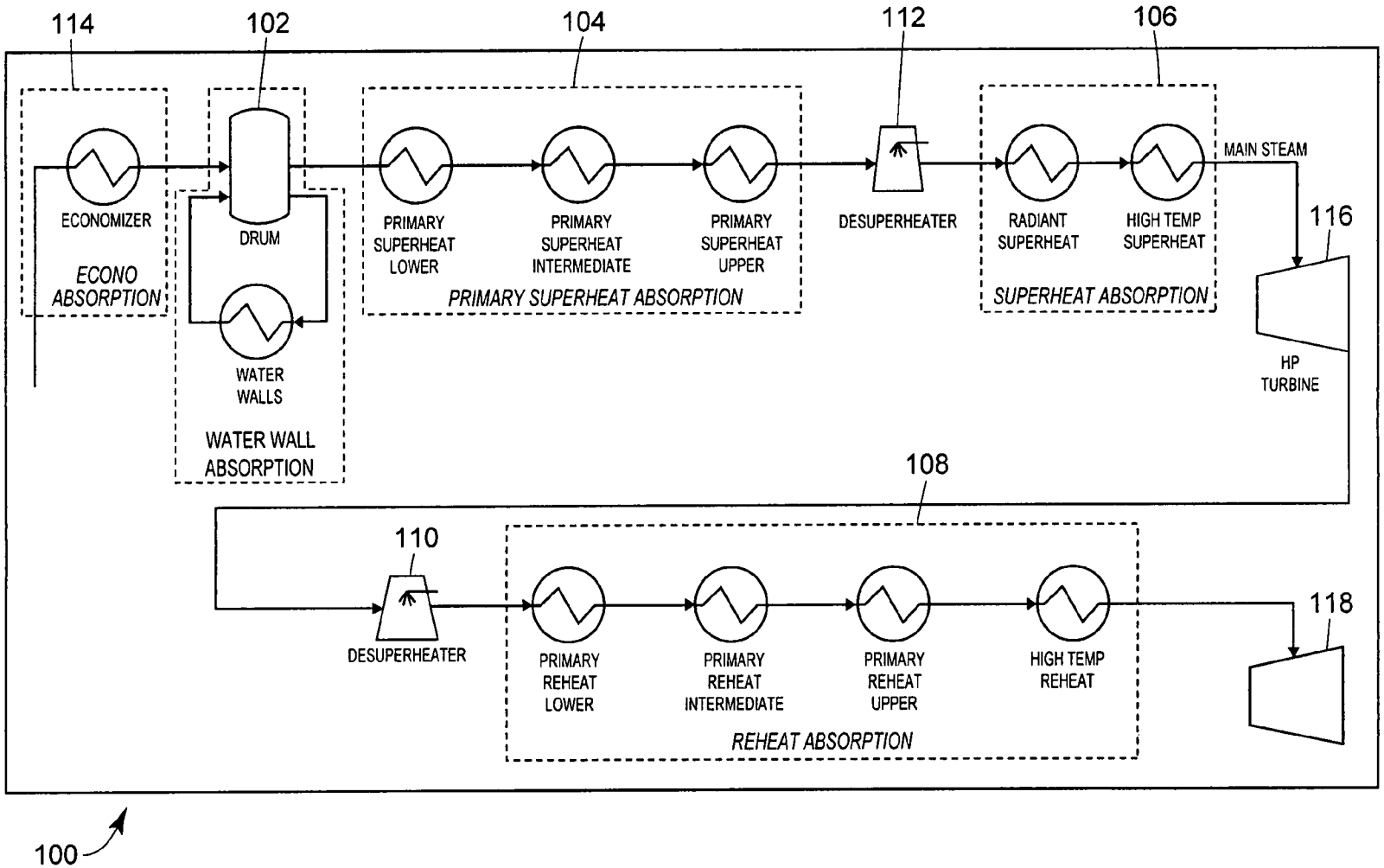
FIG. 1 illustrates a block diagram of a boiler steam cycle for a typical boiler.

FIG. 1 illustrates a block diagram of a boiler steam cycle for a typical boiler 100 that may be used, for example, by a thermal power plant. The boiler 100 may include various sections through which steam or water flows in various forms such as superheated steam, reheat steam, etc. While the boiler 100 illustrated in FIG. 1 has various boiler sections situated horizontally, in an actual implementation, one or more of these sections may be positioned vertically, especially because flue gases heating the steam in various boiler sections, such as a water wall absorption section, rise vertically.

The boiler 100 includes a water wall absorption section 102, a primary superheat absorption section 104, a superheat absorption section 106 and a reheat section 108. Additionally, the boiler 100 may also include one or more de-superheaters 110 and 112 and an economizer section 114. The main steam generated by the boiler 100 is used to drive a high pressure (HP) turbine 116 and the hot reheat steam coming from the reheat section 108 is used to drive an intermediate pressure (IP) turbine 118. Typically, the boiler 100 may also be used to drive a low pressure (LP) turbine, which is not shown in FIG. 1.

The water wall absorption section 102, which is primarily responsible for generating steam, includes a number of pipes through which steam enters a drum. The feed water coming into the water wall absorption section 102 may be pumped through the economizer section 114. The feed water absorbs a large amount of heat when in the water wall absorption section 102. The water wall absorption section 102 has a steam drum, which contains both water and steam, and the water level in the drum has to be carefully controlled. The steam collected at the top of the steam drum is fed to the primary superheat absorption section 104, and then to the superheat absorption section 106, which together raise the steam temperature to very high levels. The main steam output from the superheat absorption section 106 drives the high pressure turbine 116 to generate electricity.

Once the main steam drives the HP turbine 116, the steam is routed to the reheat absorption section 108, and the hot reheat steam output from the reheat absorption section 108 is used to drive the IP turbine 118. The de-superheaters 110 and 112 may be used to control the final steam temperature to be at desired set-points. Finally, the steam from the IP turbine 118 may be fed through an LP turbine (not shown here) to a steam condenser-(not shown here), where the steam is condensed to a liquid form, and the cycle begins again with various boiler feed pumps pumping the feed water for the next cycle. The economizer section 114 that is located in the flow of hot exhaust gases exiting from the boiler uses the hot gases to transfer additional heat to the feed water before the feed water enters the water wall absorption section 102.

Figure 2:
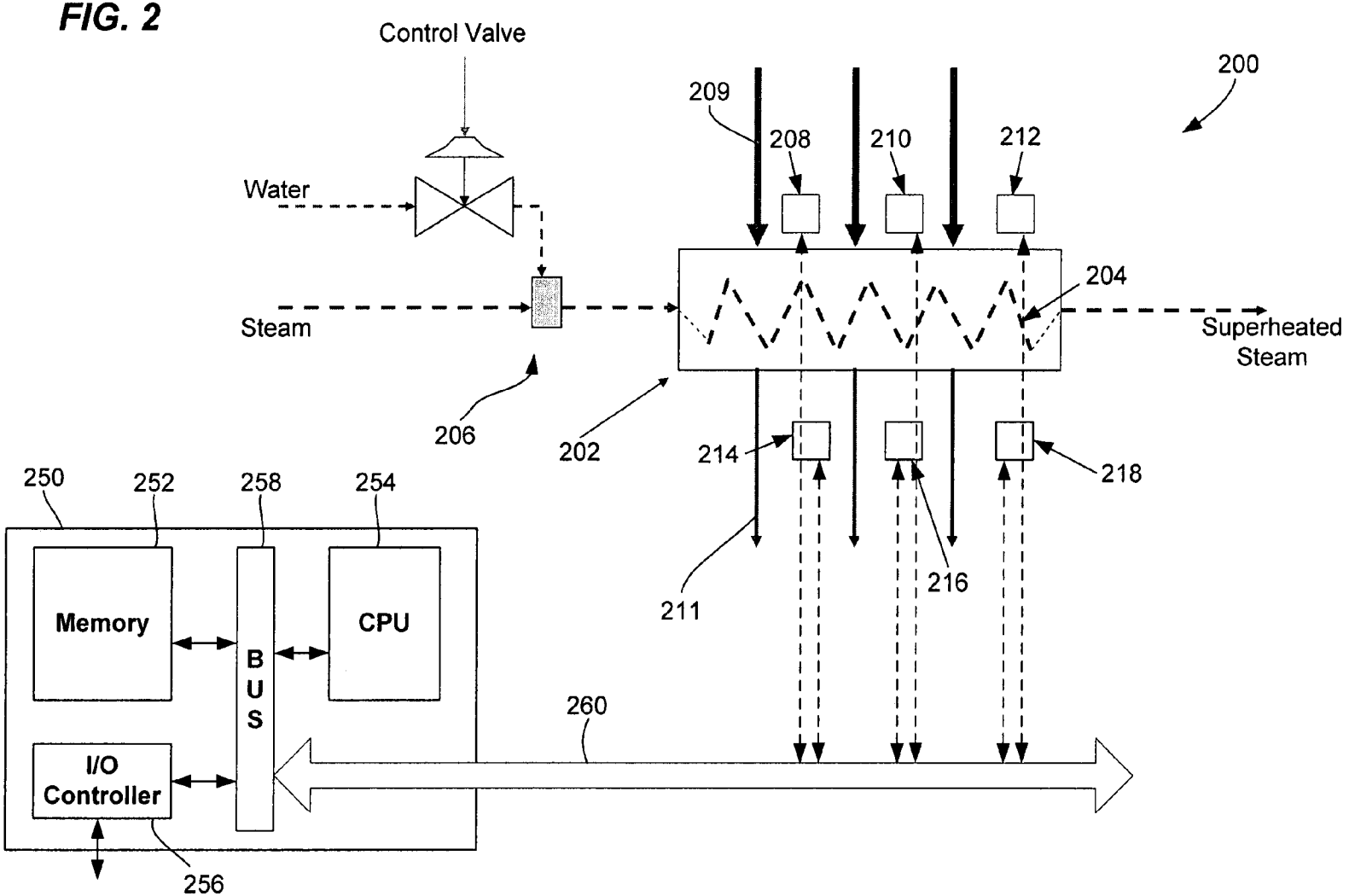
FIG. 2 illustrates a schematic diagram of an exemplary boiler section using a plurality of soot blowers.

FIG. 2 is a schematic diagram of a boiler section 200 having a heat exchanger 202 located in the path of flue gas from the boiler 100. The boiler section 200 may be part of any of the various heat exchange sections described above, such as the primary superheat absorption section 104, the reheat absorption section 108, etc. One of ordinary skill in the art would appreciate that, while the present example of the boiler section 200 may be located in a specific part of the boiler 100, the soot blower control method illustrated in this patent can be applied to any section of the boiler where heat exchange and soot build-up may occur.

The heat exchanger 202 includes a number of tubes 204 for carrying steam which is mixed together with spray water in a mixer 206. The heat exchanger 202 may convert the mixture of the water and steam to superheated steam. The flue gases input to the reheat section 200 are shown schematically by the arrows 209, and the flue gases leaving the boiler section 200 are shown schematically by the arrows 211. The boiler section 200 is shown to include six soot blowers 208, 210, 212, 214, 216 and 218, for removal of soot from the external surface of the heat exchanger 202.

The operation of the soot blowers 208, 210, 212, 214, 216 and 218 may be controlled by an operator via a computer 250. The computer 250 may be designed to store one or more computer programs on a memory 252, which may be in the form of random access memory (RAM), read-only memory (ROM), etc., wherein such a program may be adapted to be processed on a central processing unit (CPU) 254 of the computer 250. A user may communicate with the computer 250 via an input/output controller 256. Each of the various components of the computer 250 may communicate with each other via an internal bus 258, which may also be used to communicate with an external bus 260. The computer 250 may communicate with each of the various soot blowers 208, 210, 212, 214, 216 and 218 using the external communication bus 260.

The soot blowers 208-218 may be operated according to a particular soot blowing sequence, specifying the order in which each of the soot blowers 208-218 is to be turned on, the frequency of operation of the soot blowers 208-218, the length of time each soot blower is on, etc. While a given section of a fuel burning boiler may have a number of different heat exchange sections, the supply of steam and water that may be used for soot blowing operations is limited. Therefore, each heat exchange section is assigned a priority level according to which the soot blowers of that heat exchange section are operated. Soot blowers in a heat exchange section with a higher priority will receive needed water and steam to operate fully and the soot blowers in heat exchange sections with lower priorities will operate only when the needed water and steam are available. As described in further detail below, the priority level of a particular heat exchange section may be changed according to a program implemented for controlling the soot blowers of that particular heat exchange section.

Figure 3:
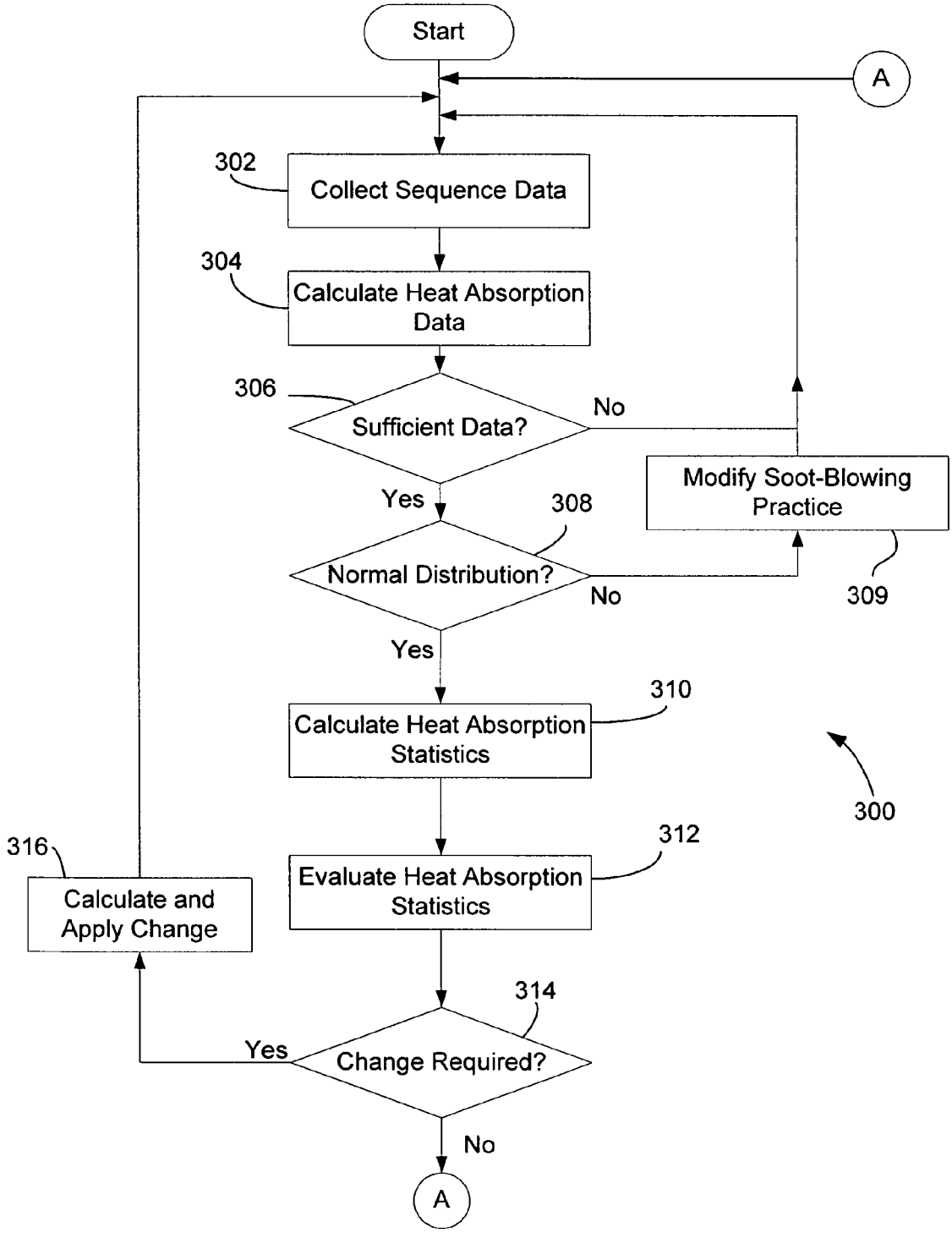
FIG. 3 illustrates a flowchart of an exemplary heat absorption statistics calculation program.

FIG. 3 illustrates a flowchart of a heat absorption statistics calculation program 300 that may be used to calculate heat absorption statistics in any of the various sections of the boiler 100, such as the boiler section 200. The heat absorption statistics calculation program 300 may be implemented as software, hardware, firmware or as any combination thereof. When implemented as software, the heat absorption statistics calculation program 300 may be stored on a read only memory (ROM), a random access memory (RAM) or any other memory device used by a computer used to implement the soot blowing process control program 300. The heat absorption statistics calculation program 300 may be used to calculate heat absorption statistics of only one section of the boiler 100 or, alternatively, may be used to calculate heat absorption statistics of all the heat exchange sections in the boiler 100.

A block 302 initiates the calculation of heat absorption statistics by establishing an initial sequence of operation (current operational sequencing). Such current operational sequencing may be characterized by various parameters defining a timeline for operating each of the plurality of soot blowers within a boiler section, such as the boiler section 200. For example, an implementation of the heat absorption statistics calculation program 300 may specify the frequency at which the soot blower 208 is turned on, the length of time for which the soot blower 208 is kept on, and the length of time for which the soot blower 208 is turned off between two consecutive on time periods.

The block 302 also collects and stores various data related to the steam flowing through the boiler section 200. For example, the block 302 may collect the temperature and pressure of the steam entering the boiler section 200 and may calculate the entering enthalpy of the boiler section 200 (enthalpy is the heat energy content of a fluid, which has a unit of Btu/lb) denoted by Hi, the temperature and pressure of the steam exiting from the boiler section 200, the exiting enthalpy of the boiler section 200, denoted by Ho, the rate of flow of steam into the boiler section 200, denoted by F lbs/Hr, etc.

A block 304 calculates and stores the heat absorption within the boiler section 200, using the data collected by the block 302. In our case, the heat absorption of the boiler section 200, denoted by Q may be given as:

$$Q=F*(H_o-H_i)$$

Alternatively, in some heat exchange sections, such as a sub-section of the water wall absorption section 102 of the boiler 100, the heat absorption Q may be measured directly using a heat flux sensor.

A block 306 of FIG. 3 evaluates the amount of heat absorption data collected and stored by the block 304. For example, a user may have specified the number of observations that must be collected by the soot blowing process control program, in which case the block 306 compares the collected data with such a specification provided by the user. If the block 306 determines that more data is necessary, control passes back to the block 302.

When the block 306 determines that a sufficient amount of heat absorption data has been collected, a block 308 determines if the collected data adheres to a normal distribution. A user may provide the confidence level at which the heat absorption statistics calculation program 300 needs to determine whether the heat absorption data is normally distributed or not. For example, a user may specify that the heat absorption data must be normally distributed at a ninety-five percent confidence level, etc. If the block 308 determines that the heat absorption data is not normally distributed at the specified confidence level, which may be a result of an erratic soot blowing sequencing, a block 309 modifies the current operational sequencing for operating the soot blowers within the boiler section 200 so that the operational sequencing is more consistent. Subsequently, the control passes back to the block 302 and more data is collected to obtain more observation points of heat absorption data.

If the block 308 determines that the heat absorption data is normally distributed, a block 310 calculates a plurality of heat absorption statistical data for the boiler section 200. For example, the block 310 may calculate a heat absorption mean, a heat absorption median, a heat absorption variance, a heat absorption standard deviation, a heat absorption skewness, etc.

Subsequently, a block 312 evaluates the heat absorption statistical data calculated by the block 310. In particular, the block 312 may evaluate the heat absorption statistical data against a number of measures provided by a user of the heat absorption statistics calculation program 300 or against a number of industry averages, etc.

In an implementation of the heat absorption statistics calculation program 300, the block 312 may be provided with a target lower control limit and a target upper control limit against which the actual heat absorption of the boiler section is evaluated. Alternatively, the heat absorption statistics calculation program 300 may calculate the target lower control limit and the target upper control limit using long term heat absorption statistical data calculated by the block 310. For example, an implementation of the heat absorption statistics calculation program 300 may determine a target lower control limit and the target upper control limit using the heat absorption mean and the heat absorption standard deviation.

After evaluating the heat absorption statistics at the block 312, a block 314 determines if it is necessary to change the current operational sequencing of the soot blowers. For example, the block 314 may determine that it is necessary to change at least one of the frequencies at which the soot blowers are turned on, the length of time that the soot blowers are kept on, the length of time that the soot blowers are turned off between two consecutive on time periods, etc. In one implementation of the heat absorption statistics calculation program 300, the block 314 may determine that if the actual heat absorption mean is lower than the target lower control limit, then it is necessary to change one or more of the operating parameters of the current operational sequencing.

If the block 314 determines that it is necessary to change the current operational sequencing of the soot blowers, a block 316 calculates a change to be applied to any of the various parameters of the current operational sequencing. The block 316 may use various heat absorption statistics calculated by the block 310 to determine the change to be applied to the operating parameters of the current operational sequencing. For example, in an implementation of the heat absorption statistics calculation program 300, the block 314 may determine that the change to be applied to the length of time for which the soot blowers are to be kept on should be a function of the difference between the actual heat absorption mean and the target lower control limit. However, the block 314 may also determine that the soot blowing is working effectively, and that it is not necessary to change the current operational sequencing of the soot blowers, in which case the control may transfer to the block 302 for continuous monitoring of the soot blowing process without any changes.

Note that while the heat absorption statistics calculation program 300 is illustrated in FIG. 2 and described above with respect to the boiler section 200, the heat absorption statistics calculation program 300 can also be applied to any other heat exchange section of the boiler 100. Moreover, while the functions performed by the blocks 312-316 are illustrated in the heat absorption statistics calculation program 300 as being performed by three different blocks, in an alternate implementation, these functions may be performed by a single block or by a separate program.

Figure 4A:
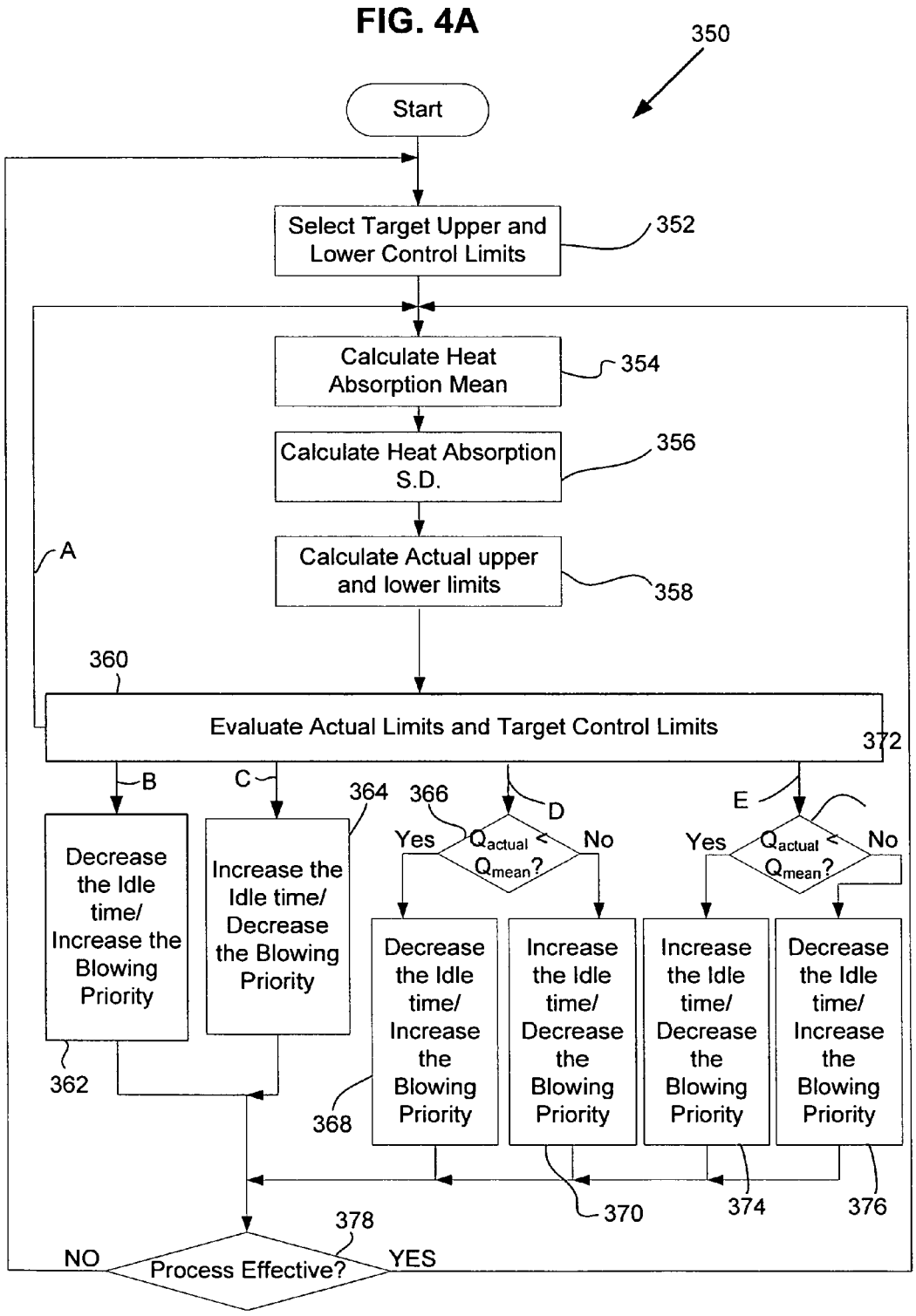
FIG. 4A illustrates a flowchart of a soot blowing statistical process control program.

FIG. 4A illustrates a flowchart of an implementation of a statistical process control program 350 that may perform the functions of the blocks 312-316. A block 352 may determine characteristics of a desired distribution of the heat absorption values for a particular heat exchange section. Determining such characteristics may include selecting a target lower control limit QLCL, a target upper control limit QUCL, and other characteristics of the desired distribution for that particular heat exchange section. Subsequently, a block 354 may calculate a heat absorption mean Qmean using the following equation:

$$Q_{mean} = \frac{1}{N}\sum_{i=1}^{N} Q_i$$

where N represents the number of heat absorption observations included in a given sample and Qi is the value of heat absorption for the ith observation. A block 356 may calculate a heat absorption standard deviation Qσ using the following equation:

$$Q_{\sigma} = \left[\frac{1}{N}\sum_{i=1}^{N}(Q_i - Q_{mean})^2\right]^{1/2}$$

Subsequently, a block 358 may determine an actual lower limit Qm−3σ and an actual upper limit Qm+3σ on a curve depicting a distribution of various heat absorption values. While in the present implementation of the statistical process control program 350, the actual lower limit Qm−3σ and the actual upper limit Qm+3σ are functions of only the heat absorption mean Qmean and the heat absorption standard deviation Qσ, in an alternate implementation, alternate statistical values, such as variance, may be used to calculate an alternate actual lower limit and an alternate actual upper limit. Moreover, while in the present example, the actual lower limit Qm−3σ and the actual upper limit Qm+3σ are determined to be at 3-sigma points (3σ) away from the heat absorption mean Qmean, in practice, an alternate actual lower limit of Qm−xσ and an alternate actual upper limit of Qm+xσ, located at x-sigma points (wherein x is a number that may be selected by the user of the statistical process control program 350) away from the heat absorption mean Qmean may also be used. If desired, x may be an integer or may be any real number.

Subsequently, a block 360 compares the actual lower limit Qm−3σ with a target lower control limit QLCL and the actual upper limit Qm+3σ with the target upper control limit QUCL. The block 360 may be provided with a series of rules that may be used for performing the comparison based on the result of the comparison, the block 360 may generate a decision regarding a change that needs to be made to one or more parameters of the current operational sequencing.

Evaluating the actual lower limit Qm−3σ and the actual upper limit Qm+3σ for a particular heat exchange section provides information regarding actual distribution of the heat absorption values for that particular heat exchange section. By comparing the actual lower limit Qm−3σ with a target lower control limit QLCL and the actual upper limit Q m+3σ with the target upper control limit QUCL, the block 360 of the statistical process control program 350 determines whether the actual distribution of the heat absorption values, as measured over a particular period of time, is approximately equal to the desired distribution of the heat absorption values or not.

If the block 360 determines that the actual lower limit Qm−3σ is approximately equal to the target lower control limit QLCL and that the actual upper limit Q m+3σ is approximately equal to the target upper control limit QUCL, the actual distribution of the heat absorption values is approximately equal to the desired distribution of the heat absorption values. In this case, the block 360 may decide that the current operational sequencing used to operate the soot blowers is functioning properly, or that desired control of the soot blowing operations is successfully achieved. Therefore, no change is necessary to any operating parameters of the current operational sequencing, and control passes back to the block 354, as shown by the path A in FIG. 4A.

In some situations, the block 360 may determine that the target lower control limit is greater than the actual lower limit (QLCL>Qm−3σ) and that the target upper control limit is also greater than the actual upper control limit (QUCL>Qm+3σ). This outcome (path B in FIG. 4A) signifies that the actual distribution of the heat absorption observations is situated to the left of the desired distribution, as illustrated by a distribution 380 in FIG. 4B. In this situation, a block 362 (which may be implemented by the block 316 of FIG. 3) may decrease the idle time between successive soot blowing operations in the current operational sequencing or increase the soot blowing priority of the heat exchange section, so as to shift the actual distribution of heat absorption observations to the right. The lower idle time or the higher blowing priority results in more frequent soot blowing operations and therefore removal of higher amounts of soot deposits, which results in narrowing the distribution of the heat absorption data to a desired level specified by the target lower control limit QLCL and the target upper control limit QUCL. The amount of change in the idle time and the blowing priority may be determined empirically by a user of the boiler 100.

In another situation, the block 360 may determine that the target lower control limit is lower than the actual lower limit (QLCL<Qm−3σ) and that the target upper control limit is also lower than the actual upper control limit (QUCL<Qm+3σ). This outcome (path C in FIG. 4A) signifies that the distribution of the heat absorption observations is situated to the right of the desired distribution, as illustrated by a distribution 382 in FIG. 4B. Generally, this situation may signify excessive soot blowing. In this situation, a block 364 may increase the idle time between successive soot blowing operations in the current operational sequencing, or decrease the soot blowing priority of the heat exchange section, so as to shift the actual distribution of heat absorption observations to the left. The higher idle time or the lower blowing priority results in less frequent soot blowing operations and therefore removal of lesser amounts of soot deposits, which results in broadening the distribution of the heat absorption data to a desired level specified by the target lower control limit QLCL and the target upper control limit QUCL. The amount of change in the idle time and the blowing priority may be determined empirically by a user of the boiler 100.

Alternatively, the block 360 may determine that the target lower control limit is higher than the actual lower limit (QLCL>Qm−3σ) and that the target upper control limit is lower than the actual upper control limit (QUCL<Qm+3σ). This outcome (outcome D in FIG. 4A) signifies that the actual distribution of the heat absorption observations is broader than the desired distribution, as illustrated by a distribution 384 in FIG. 4B. In this situation, a block 366 compares the current actual heat absorption Qactual with the mean heat absorption Qmean. If the block 366 determines that Qactual<Qmean, then a block 368 decreases the idle time between successive soot blowing operations or increases the soot blowing priority of the heat exchange section. The lower idle time or the higher blowing priority results in more frequent soot blowing operations and therefore removal of higher amounts of soot deposits, which results in shifting the actual lower control limit Qm−3σ towards the desired lower control limit QLCL. The amount of change in the idle time and the blowing priority may be determined empirically by a user of the boiler 100.

On the other hand, if the block 366 determines that Qactual>Qmean, then a block 370 increases the idle time between successive blowing operations or decreases the soot blowing priority of the heat exchange section. The higher idle time or the lower blowing priority results in less frequent soot blowing operations and therefore removal of lesser amounts of soot deposits, which results in shifting the actual upper control limit Qm+3σ towards the desired upper control limit QUCL. The amount of change in the idle time and the blowing priority may be determined empirically by a user of the boiler 100.

Still further, the block 360 may determine that the target lower control limit is lower than the actual lower limit (QLCL<Qm−3σ) and that the target upper control limit is greater than the actual upper control limit (QUCL>Qm+3σ. This outcome (path E in FIG. 4A) signifies that the actual distribution of the heat absorption observations is narrower than the desired distribution, as illustrated by a distribution 386 in FIG. 4B. In this situation, a block 372 compares the current actual heat absorption Qactual with the mean heat absorption Qmean. If the block 372 determines that Qactual<Qmean, then a block 374 increases the idle time between successive blowing operations or decreases the soot blowing priority of the heat exchange section. The higher idle time or the lower blowing priority results in less frequent soot blowing operations and therefore removal of lesser amounts of soot deposits, which results in shifting the actual upper control limit Qm+3σ towards the desired upper control limit QUCL. The amount of change in the idle time and the blowing priority may be determined empirically by a user of the boiler 100.

On the other hand, if the block 372 determines that Qactual>Qmean, then a block 376 decreases the idle time between successive blowing operations or increases the soot blowing priority of the heat exchange section. The lower idle time or the higher blowing priority results in more frequent soot blowing operations and therefore removal of higher amounts of soot deposits, which results in shifting the actual lower control limit Qm−3σ towards the desired lower control limit QLCL. The amount of change in the idle time and the blowing priority may be determined empirically by a user of the boiler 100.

Subsequently, a block 378 evaluates the effectiveness of the process undertaken by the blocks 354-376 to determine if the current selection of the target upper control limit QUCL and the target lower control level QLCL are effective in controlling the operations of the soot blowers for the particular heat exchange section. The block 378 may collect various statistical data related to the shifting of the distribution curves 380-386 over several cycles of operation of the blocks 354-376. If the block 378 determines at the end of such several cycles that the distribution curves 380-386 have shifted significantly to a newer position, such as, for example, a position signified by the distribution curve 384 (of FIG. 4B), the block 378 may decide that the process undertaken by the blocks 354-376 is not effective in preventing slagging in the heat exchange section, and therefore, pass control back to the block 352 and ask the user of the statistical process control program 350 to select new values for the target upper control limit QUCL and the target lower control limit QLCL.

A broad distribution of the heat absorption values as illustrated by the curve 380 may signify that while the average heat transfer efficiency of the heat exchange section has not changed over time, individual observations of the heat transfer efficiency are more likely to vary from the average heat transfer efficiency. On the other hand, a narrow distribution of the heat absorption values as illustrated by the curve 382 may signify that while the average heat transfer efficiency of the heat exchange section has not changed over time, individual observations of the heat transfer efficiency are less likely to vary from the average heat transfer efficiency.

The shifting of the distribution of the heat absorption values to the left, as illustrated by the distribution curve 384 may signify an overall reduction in heat transfer efficiency of the heat exchange section due to higher amount of soot deposits (slagging) in the heat exchange section. On the other hand, the shifting of the distribution of the heat absorption values to the right, as illustrated by the distribution curve 386 may signify an overall increase in heat transfer efficiency of the heat exchange section. Such increased efficiency may be a result of the higher rate of soot-blowing than necessary and may damage to various water and steam carrying tubes in the heat exchange section.

Figure 4B:
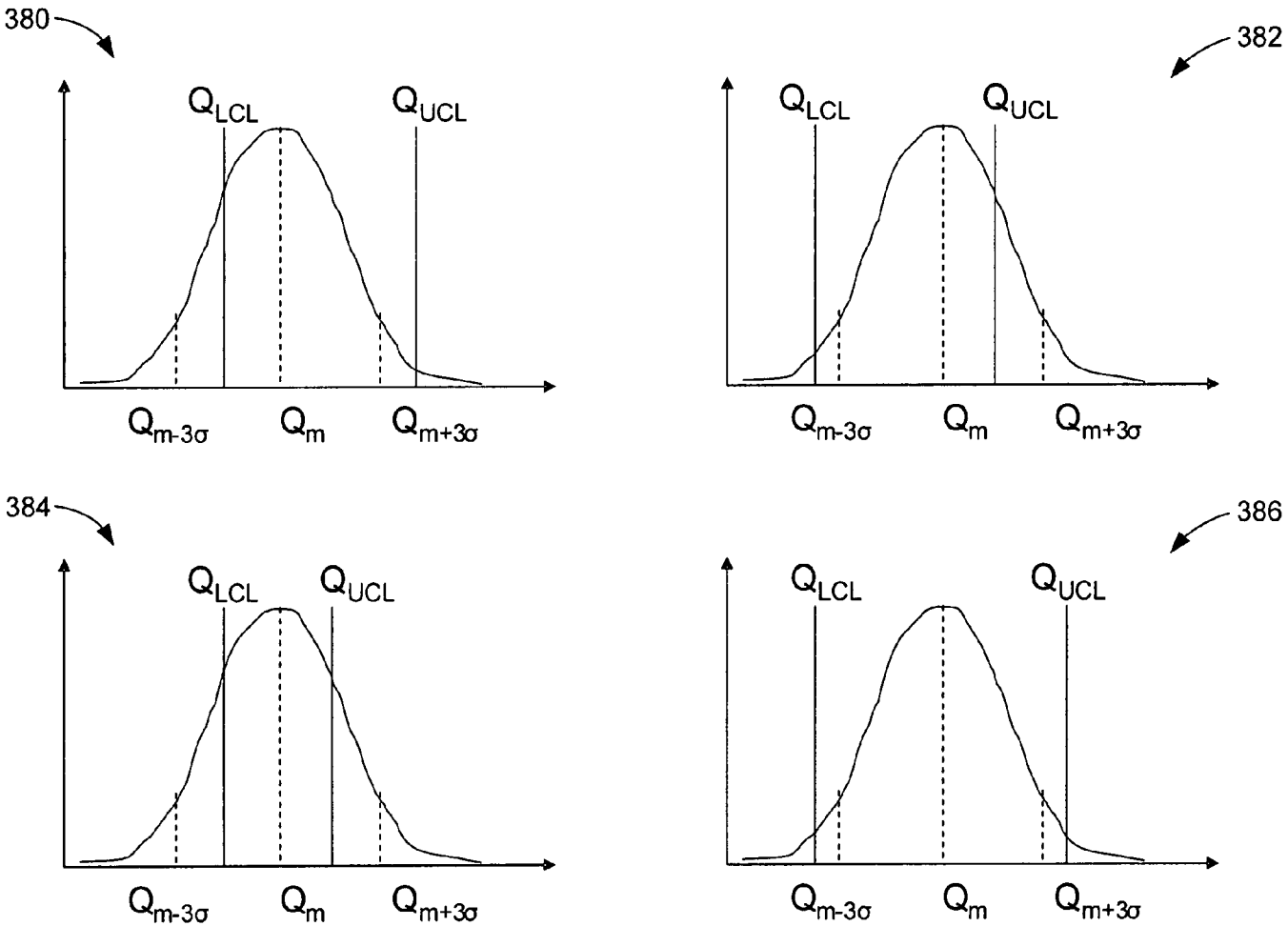
FIG. 4B illustrates a plurality of heat absorption data distribution curves.
Figure 5:
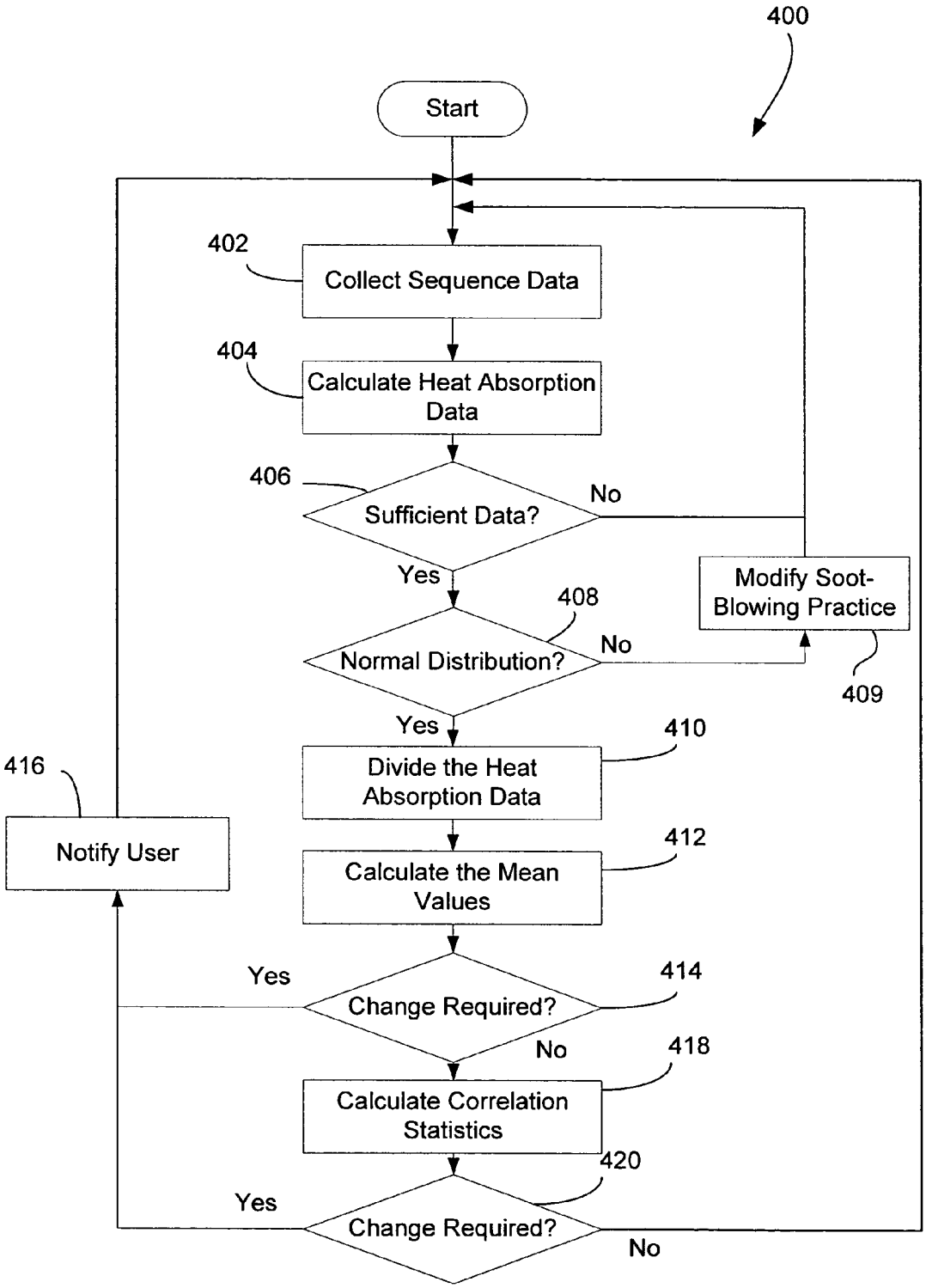
FIG. 5 illustrates a flowchart of a permanent slagging detection program.

While FIGS. 4A-4B illustrate one implementation of the statistical process control program 350, FIG. 5 illustrates another statistical process control program that can be used to determine permanent slagging within a heat exchange section of the boiler 100. Specifically, FIG. 5 illustrates a slagging detection program 400 that evaluates the distribution data of the changes in the heat absorption resulting from soot blowing and the correlation between a heat absorption change mean ΔQmean and a frequency of soot blowing in a particular heat exchange section to determine any permanent slagging in that particular heat exchange section.

Figure 6:
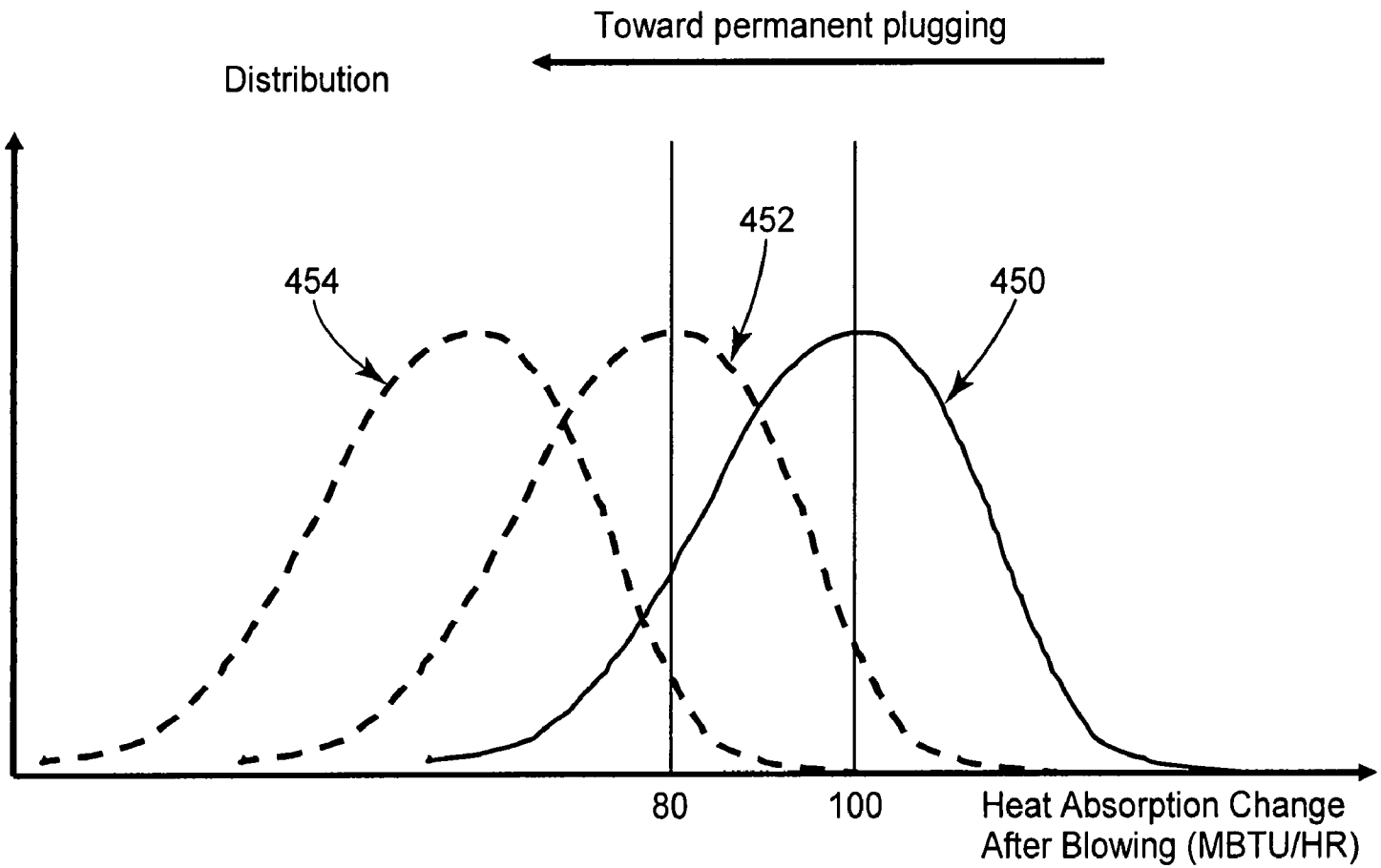
FIG. 6 illustrates a plurality of heat absorption distribution curves illustrating permanent slagging.

This situation is further illustrated by a series of distribution curves 450-454 in FIG. 6, wherein each of the curves

450-454 represents a distribution of heat absorption change values ΔQ for a particular heat exchange section over a particular period of time, wherein ΔQ may be defined as:

$$\Delta Q = Q_{after\text{-}sootblowing} - Q_{before\text{-}sootblowing}$$

For example, the curve 450 may represent a desired distribution of heat absorption change values for that particular heat exchange section. In an ideal case, the heat absorption change mean ΔQmean may have a value of approximately 100, as illustrated in FIG. 6. However, due to permanent slagging (i.e., the soot blowing not being effective any more), the curve 450 may have shifted to a position represented by the curve 452, wherein the actual absorption change mean ΔQmean may become approximately equal to only 80 or even less. The slagging detection program 400 may be used to determine such slagging in a heat exchange section.

The operation of the blocks 402-409 of the slagging detection program 400 are similar to that of the blocks 302-309 of the heat absorption statistics calculation program 300, except that while the blocks 302-309 calculate various statistics regarding heat absorption Q for a particular heat exchange section, the blocks 402-409 calculate various statistics regarding changes in the heat absorption ΔQ for a particular heat exchange section. Subsequently, a block 410 divides the heat absorption data into various temporal sections. For example, if the slagging detection program 400 has heat absorption data associated with, for example, one month of operations of the heat exchange section, the block 410 may temporally divide such heat absorption data into various sets of data. Alternatively, the block 410 may store the last certain number of periods of data on a rolling basis, such that only the last month's data are analyzed and any data from the prior periods are discarded.

A block 412 calculates the mean values for the various groups of data as provided by the block 410. For example, the block 412 may calculate the mean absorption change values for each day of the previous month. Subsequently, a block 414 analyzes these mean values to determine if there is a trend in this data. Specifically, the block 414 determines if the mean values are showing any gradual decline or increase over time. A gradual decline in mean values may indicate that the heat exchange section is trending towards permanent slagging and that a change is necessary in the current soot blowing practice. If a shift in the mean absorption change is detected, a correlation analysis may be performed.

A block 418 calculates and evaluates the correlation between the heat absorption change mean ΔQmean for a particular heat exchange section and the frequency of soot blowing in that particular heat exchange section, denoted by Corrm,f. A block 420 may determine whether the correlation value Corrm,f is higher than a given threshold value at a certain confidence level. If the correlation value Corrm,f is higher than the given threshold value, signifying a shifting of the heat absorption change mean ΔQmean to the left being significantly related to the frequency of soot blowing, the block 420 may transfer control back to the block 402 to continue operation of the slagging detection program 400 in its normal mode. However, if the block 418 determines that the correlation is not higher than the threshold value, the block 420 notifies the user that there is a potentially permanent slagging condition in the heat exchange section being evaluated. Note that while the above implementation of the slagging detection program 400 uses the correlation between the heat absorption change mean ΔQmean and the frequency of soot blowing, in an alternate implementation, correlation between the heat absorption change mean ΔQmean and the length of time for which the soot blowers are kept on during each sequence, or some other parameter of the current operational sequencing, may also be used.

Although the forgoing text sets forth a detailed description of numerous different embodiments of the invention, it should be understood that the scope of the invention is defined by the words of the claims set forth at the end of this patent. The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent, which would still fall within the scope of the claims defining the invention.

Thus, many modifications and variations may be made in the techniques and structures described and illustrated herein without departing from the spirit and scope of the present invention. Accordingly, it should be understood that the methods and apparatus described herein are illustrative only and are not limiting upon the scope of the invention.

What is claimed is:

1. A method of controlling a soot blower located in a heat exchange section, the method comprising:

operating the soot blower according to an operating sequence for a first period of time;

determining heat absorption data of the heat exchange section during the first period of time;

determining a heat absorption statistical value from the heat absorption data; and evaluating the heat absorption statistical value to determine a change in an operating parameter of the operating, sequence.

2. A method of claim 1, wherein operating the soot blower further comprises operating a plurality of soot blowers located in the heat exchange section.

3. A method of claim 1, wherein determining the heat absorption statistical value further comprises determining a plurality of heat absorption statistical values.

4. A method of claim 3, wherein determining the plurality of heat absorption statistical values includes determining at least two or more of: (1) a heat absorption mean; (2) a heat absorption standard deviation; (3) a heat absorption lower limit; and (4) a heat absorption upper limit.

5. A method of claim 1, wherein determining a heat absorption statistical value includes determining a heat absorption lower limit equal to a heat absorption mean less a muitiple of a heat absorption standard deviation and determining a heat absorption upper limit equal to the heat absorption mean plus the multiple of the heat absorption standard deviation.

6. A method of claim 5, wherein evaluating the heat absorption statistical value comprises:

comparing the heat absorption upper limit with a target upper control limit; and comparing the heat absorption lower limit with a target lower control limit.

7. A method of claim 6, wherein evaluating the heat absorption statistical value to determine the change in the operating parameters of the operating sequence includes at least one of:

(1) decreasing the operating interval or increasing the operating priority, if:

(a) the target lower control limit is higher than the heat absorption lower limit and the target upper control limit is lower than the heat absorption upper limit, or (b) the target lower control limit is higher than the heat absorption lower limit, and the target upper control limit is higher than the heat absorption upper limit and a current heat absorption value is lower than the heat absorption mean, or (c) the target lower control limit is lower than the heat absorption lower limit, the target upper control limit is lower than the heat absorption upper limit and the current heat absorption value is higher than the heat absorption mean; or (2) increasing the operating interval or decreasing the operating priority, if:

(a) the target lower control limit is higher than the heat absorption lower limit and the target upper control limit is higher than the heat absorption upper limit, or (b) the target lower control limit is higher than the heat absorption lower limit, and the target upper control limit is higher than the absorption upper limit and the current heat absorption value is higher than the heat absorption mean, or (c) the target lower control limit is lower than the heat absorption tower limit, and the target upper control limit is lower than the heat absorption upper limit and the current heat absorption value is lower than the heat absorption mean.

8. A method of claim 6, wherein the change in the operating parameters of the operating sequence is a function of a difference between the heat absorption lower limit and the target lower control limit; or a difference between the heat absorption upper limit and the target upper control limit.

9. A method of claim 6, further comprising evaluating the effectiveness of the change in the operating parameters on cleanliness of the heat exchange section to adjust the change in the operating parameters.

10. A method of claim 9, wherein the effectiveness of the change in the operating parameters of the operating sequence is evaluated by measuring a shift in the distribution of the heat absorption data.

11. A method of claim 1, wherein determining the heat absorption statistical value includes determining a heat absorption change mean value.

12. A method of claim 11, wherein determining the heat absorption statistical value includes determining a plurality of heat absorption change mean values; and further comprising determining a frequency correlation value representing a correlation between the plurality of heat absorption change mean values and a plurality of soot blower operating frequencies.

13. A method of claim 11, wherein determining the heat absorption statistical value includes determining a plurality of heat absorption change mean values; and further comprising determining a period correlation value representing a correlation between the plurality of heat absorption change mean values and a plurality of soot blower operating periods.

14. A method of claim 1, wherein the operating parameter of the operating sequence is one of: (1) an operating frequency; (2) an operating interval; (3) an operating priority; or (4) an operating time period.

15. A method of claim 1, wherein the heat exchange section is one of: (1) a water wall absorption section; (2) a superheat section; (3) a reheat absorption section; (4) an economizer; or (5) an air heater.

16. A method of claim 1, wherein determining the heat absorption data comprises:

determining entering enthalpy of the heal exchange section;

determining exiting enthalpy of the heat exchange section;

calculating a differential enthalpy as a difference between the exiting enthalpy and the entering enthalpy; and multiplying the differential enthalpy by a steam flow rate in the heat exchange section to obtain the heat absorption data of the heat exchange section.

17. A method of claim 1, further comprising analyzing a distribution of the heat absorption data to determine if the distribution of the heat absorption data conforms to normal distribution.

* * * * *

UNITED STATES PATENT AND TRADEMARK OFFICE

CERTIFICATE OF CORRECTION

PATENT NO. : 7,383,790 B2
APPLICATION NO. : 11/146170
DATED : June 10, 2008
INVENTOR(S) : Peter N. Francino et al.

It is certified that error appears in the above-identified patent and that said Letters Patent is hereby corrected as shown below:

At Column 4, line 14, “condenser-(not” should be -- condenser (not --.

At Column 13, line 23, “tower” should be -- lower --.

Signed and Sealed this

Twenty-fourth Day of March, 2009

JOHN DOLL
*Acting Director of the United States Patent and Trademark Office*